US010222733B2

(12) United States Patent
Tamura

(10) Patent No.: US 10,222,733 B2
(45) Date of Patent: Mar. 5, 2019

(54) IMAGE FORMING APPARATUS AND IMAGE FORMATION SYSTEM

(71) Applicant: Konica Minolta, Inc., Chiyoda-ku, Tokyo (JP)

(72) Inventor: Hitoshi Tamura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/097,656

(22) Filed: Apr. 13, 2016

(65) Prior Publication Data

US 2016/0313686 A1 Oct. 27, 2016

(30) Foreign Application Priority Data

Apr. 22, 2015 (JP) ..... 2015-087589

(51) Int. Cl.
*G03G 15/00* (2006.01)

(52) U.S. Cl.
CPC ..... *G03G 15/6523* (2013.01); *G03G 15/6567* (2013.01); *G03G 15/6573* (2013.01)

(58) Field of Classification Search
CPC ..... G03G 15/6523
USPC ..... 399/385
See application file for complete search history.

(56) References Cited

U.S. PATENT DOCUMENTS 3,855,890 A * 12/1974 Lynch ..... B26D 1/225 399/385
4,046,470 A * 9/1977 Yamamoto ..... G03G 15/6523 399/213
5,007,318 A * 4/1991 Cox ..... B23D 19/04 83/422
5,229,827 A * 7/1993 Sato ..... G03G 15/6523 101/224
5,344,091 A * 9/1994 Molison ..... B26D 1/385 242/527.1
5,348,527 A * 9/1994 Beckwith ..... B65H 31/32 493/413

(Continued)

FOREIGN PATENT DOCUMENTS

JP 60128163 A 7/1985
JP 2005262409 A 9/2005

(Continued)

OTHER PUBLICATIONS

JPO Notice of Reasons for Rejection corresponding to Application No. 2015-087589; dated May 30, 2017.

*Primary Examiner* — Anthony Nguyen
(74) *Attorney, Agent, or Firm* — Cantor Colburn LLP

(57) ABSTRACT

An image forming apparatus includes: a first conveyance roller pair configured to convey a sheet by rotating while tightly sandwiching the sheet; a rotation blade pair disposed on a downstream side of the first conveyance roller pair in a conveyance path of the sheet and configured to cut the sheet in a direction parallel to the conveyance direction by rotating while sandwiching the sheet; and a second conveyance roller pair configured to convey a cut waste sheet cut by the rotation blade pair in the sheet conveyance direction by rotating while tightly sandwiching the cut waste sheet. A rotational speed of the second conveyance roller pair is controlled at a rotational speed higher than a rotational speed of the first conveyance roller pair.

7 Claims, 4 Drawing Sheets

(56) References Cited

U.S. PATENT DOCUMENTS

| | | | | |
|---|---|---|---|---|
| 5,596,918 | A * | 1/1997 | Longwell | B23D 35/008 493/365 |
| 5,795,280 | A * | 8/1998 | Fowler | B65H 35/08 101/226 |
| 6,012,366 | A * | 1/2000 | Shimizu | B26D 1/245 83/105 |
| 2002/0079400 | A1 * | 6/2002 | Fujiwara | B65H 18/10 242/523.1 |
| 2004/0035523 | A1 * | 2/2004 | Middelstadt | B26D 1/405 156/256 |
| 2009/0078814 | A1 * | 3/2009 | Prittie | B26D 1/245 242/525 |
| 2010/0258017 | A1 | 10/2010 | Kersey et al. | |

FOREIGN PATENT DOCUMENTS

| | | | |
|---|---|---|---|
| JP | 2006255860 | A | 9/2006 |
| JP | 2008026651 | A | 2/2008 |

* cited by examiner

IMAGE FORMING APPARATUS AND IMAGE FORMATION SYSTEM

CROSS REFERENCE TO RELATED APPLICATIONS

This application is entitled to, and claims the benefit of Japanese Patent Application No. 2015-087589, filed on Apr. 22, 2015, the disclosure of which including the specification, drawings and abstract is incorporated herein by reference in its entirety.

BACKGROUND OF THE INVENTION

1. Field of the Invention

The present invention relates to an image forming apparatus and an image formation system.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to a photoconductor drum (image carrier) on which the electrostatic latent image is formed, whereby a toner image is formed. Further, the toner image is directly or indirectly transferred to a sheet, and then heat and pressure are applied to the sheet at a fixing nip of a fixing device to form an image on the sheet.

In recent years, image forming apparatuses can provide a high quality image as a result of the trend of digitization, high-definition and the like. Enhancement of image quality has led to approach to utilize electrophotographic-color image forming apparatuses in the print market and photograph market. In this approach, images having no margin at sheet end portions (frameless-printing) have been strongly desired in the fields of graphic art and photograph printing service.

Frameless-printing can be achieved by forming an image which has no margin at the end portions in the first place, or by cutting out the margin of an image after the image is formed together with the margin at the sheet end portions. In electrophotographic image forming apparatuses, when an image having no margin at the end portions is formed, a toner image having a size substantially greater than the sheet size is required to be transferred on the sheet, and as such a transfer member is contaminated with the toner falling outside the sheet size during the transferring process, thus contaminating the rear surface of the sheet. Therefore, the method of cutting the margin of the image is advantageous in view of preventing contamination of the printed image. To cut out the margin of the image, however, a cutting device for cutting out sheet end portions is additionally required.

As such a cutting device, Japanese Patent Application Laid-Open No. 2005-262409 discloses a round blade pair cutter including a first round blade and a second round blade which rotate and mesh with each other in an overlapping manner, in which a sheet is sandwiched by the first round blade and the second round blade and is cut in the sheet movement direction by relatively moving the sheet and the first and second round blades. Further, PTL 1 discloses a configuration including a separation member for separating a cut waste sheet in a predetermined direction.

With the technique disclosed in Japanese Patent Application Laid-Open No. 2005-262409, however, the orientation of the sheet at the time of the cutting changes due to the use of different sheets having different rigidities, the width of the cut waste sheet, and the travelling direction of the cut waste sheet, thus causing a quality problem of the cut surface of sheets, such as a napped cut surface and waviness in the sheet width direction. For example, when a sheet is cut at a position (for example, second round blade position) on the upstream of the nip position where the first round blade and the second round blade mesh with each other, the cut surface of the sheet is napped.

SUMMARY OF THE INVENTION

An object of the present invention is to provide an image forming apparatus and an image formation system which can prevent quality problem of a cut surface of a sheet.

To achieve the abovementioned object, an image forming apparatus reflecting one aspect of the present invention includes: a first conveyance roller pair including a rotatable first roller and a rotatable second roller, and configured to convey a sheet by rotating while tightly sandwiching the sheet; a rotation blade pair disposed on a downstream side of the first conveyance roller pair in a conveyance path of the sheet and including a rotatable first rotation blade and a rotatable second rotation blade, the rotation blade pair being configured to cut the sheet in a direction parallel to the conveyance direction by rotating while sandwiching the sheet; and a second conveyance roller pair including a third roller which is rotatable around a rotational axis identical to a rotational axis of the first rotation blade and a fourth roller which is rotatable around a rotational axis identical to a rotational axis of the second rotation blade, the second conveyance roller pair being configured to convey a cut waste sheet cut by the rotation blade pair in the sheet conveyance direction by rotating while tightly sandwiching the cut waste sheet, wherein a rotational speed of the second conveyance roller pair is controlled at a rotational speed higher than a rotational speed of the first conveyance roller pair.

Desirably, in the image forming apparatus, the first roller and the second roller are in pressure contact with each other with a first load, and the third roller and the fourth roller are in pressure contact with each other with a second load smaller than the first load.

Desirably, in the image forming apparatus, the first conveyance roller pair is a registration roller pair capable of correcting skewing of the sheet that is being conveyed.

Desirably, in the image forming apparatus, the first rotation blade is an outer blade, and the second rotation blade is an inner blade.

Desirably, in the image forming apparatus, the third roller rotates in response to a rotation driving force of the first rotation blade, and the fourth roller rotates to follow rotation of the third roller.

An image formation system reflection another aspect of the present invention includes a plurality of units including an image forming apparatus, the image formation system including: a first conveyance roller pair including a rotatable first roller and a rotatable second roller, and configured to convey a sheet by rotating while tightly sandwiching the sheet; a rotation blade pair disposed on a downstream side of the first conveyance roller pair in a conveyance path of the sheet and including a rotatable first rotation blade and a rotatable second rotation blade, the rotation blade pair being configured to cut the sheet in a direction parallel to the conveyance direction by rotating while sandwiching the sheet; and a second conveyance roller pair including a third roller which is rotatable around a rotational axis identical to a rotational axis of the first rotation blade and a fourth roller which is rotatable around a rotational axis identical to a rotational axis of the second rotation blade, the second conveyance roller pair being configured to convey a cut waste sheet cut by the rotation blade pair in the sheet conveyance direction by rotating while tightly sandwiching the cut waste sheet, wherein a rotational speed of the second conveyance roller pair is controlled at a rotational speed higher than a rotational speed of the first conveyance roller pair.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
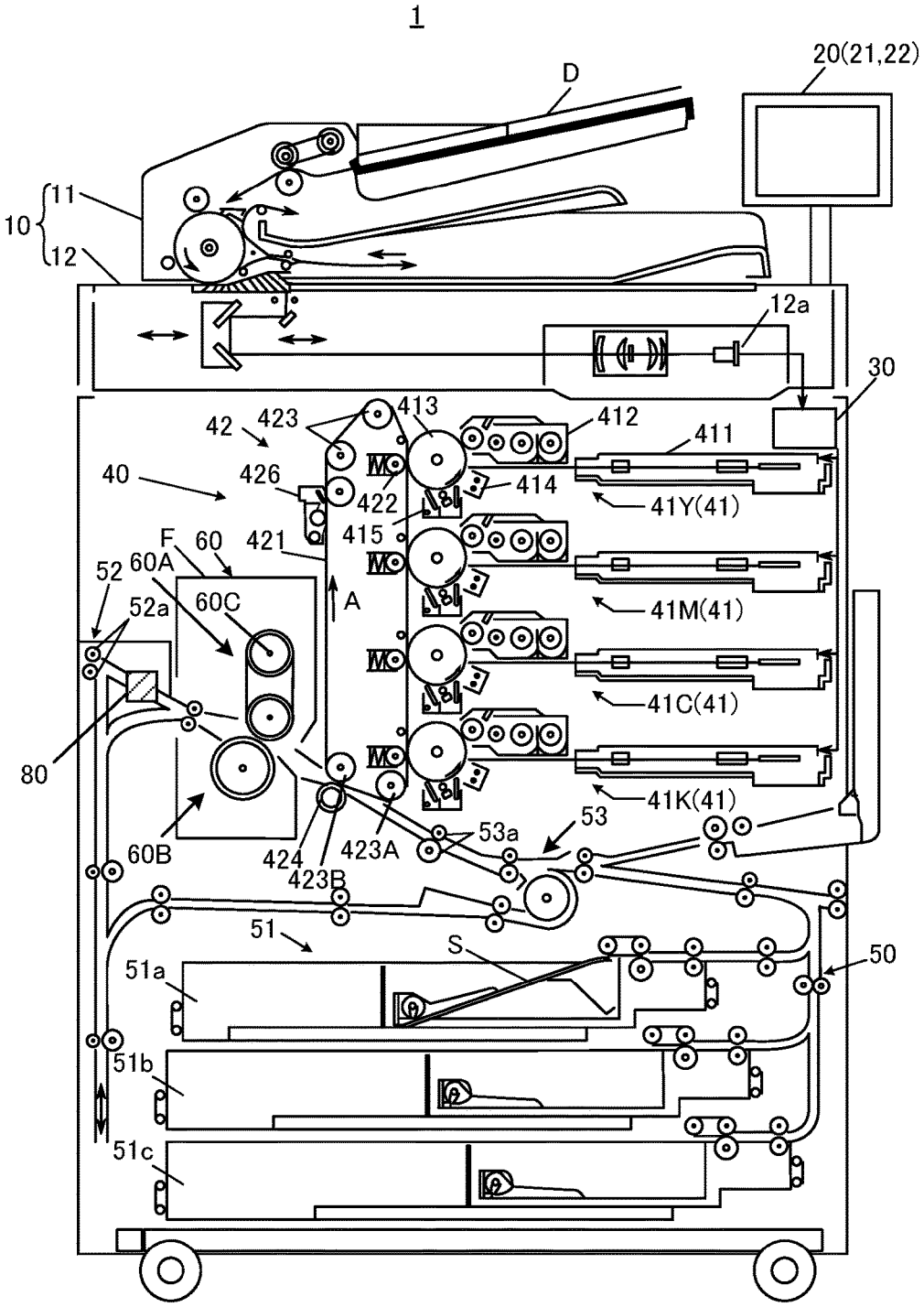
FIG. 1 schematically illustrates a general configuration of an image forming apparatus of an embodiment.
Figure 2:
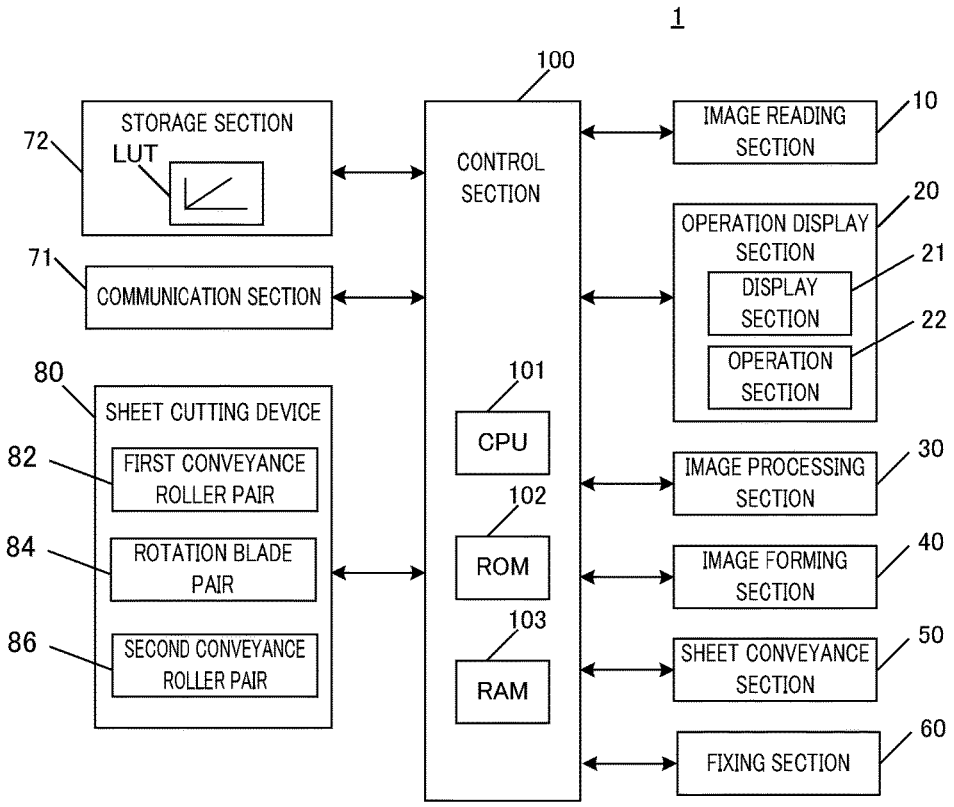
FIG. 2 is a principal part of a control system of the image forming apparatus of the embodiment.

In the following, the present embodiment is described in detail with reference to the drawings. FIG. 1 illustrates an overall configuration of image forming apparatus 1 according to the embodiment of the present invention. FIG. 2 illustrates a principal part of a control system of image forming apparatus 1 according to the embodiment. Image forming apparatus 1 illustrated in FIGS. 1 and 2 is a color image forming apparatus of an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to sheet S, to thereby form an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 1 includes image reading section 10, operation display section 20, image processing section 30, image forming section 40, sheet conveyance section 50, fixing section 60, sheet cutting device 80 and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and brings light reflected from the document into an image on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image statuses, operating conditions of each function, and the like in accordance with display control signals received from control section 100. Operation section 22 includes various operation keys such as numeric keys and a start key, receives various input operations performed by a user, and outputs operation signals to control section 100.

Image processing section 30 includes a circuit that performs a digital image process suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415 and the like.

Photoconductor drum 413 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 mm The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is, for example, a two-component development type developing device, and attaches the toners of respective color components to the surface of photoconductor drums 413 to visualize the electrostatic latent image, thereby forming a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and an electric charge of the polarity opposite to the polarity of the toner is applied to the rear side (the side that makes contact with secondary transfer roller 424) of sheet S, whereby the toner image is electrostatically transferred to sheet S. Sheet S on which the toner images have been transferred is conveyed toward fixing section 60.

Belt cleaning device 426 includes a belt cleaning blade configured to make sliding contact with the surface of intermediate transfer belt 421, and the like, and removes transfer residual toner remaining on the surface of intermediate transfer belt 421 after the secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) side of sheet S, lower fixing section 60B having a back side supporting member disposed on the rear surface (the surface opposite to the fixing surface) side of sheet S, heating source 60C, and the like. The back side supporting member is brought into pressure contact with the fixing side member, whereby a fixing nip for conveying sheet S in a tightly sandwiching manner is formed.

At the fixing nip, fixing section 60 applies heat and pressure to sheet S on which a toner image has been secondary-transferred to fix the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance.

Conveyance path section 53 includes a plurality of pairs of conveyance rollers such as a pair of registration rollers 53*a*.

Sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. An end portion of sheet S having subjected to the fixing process is cut by sheet cutting device 80 under the control of control section 100, and thereafter ejected out of image forming apparatus 1 by sheet ejection section 52 having sheet ejection roller 52*a*.

Figure 3A:
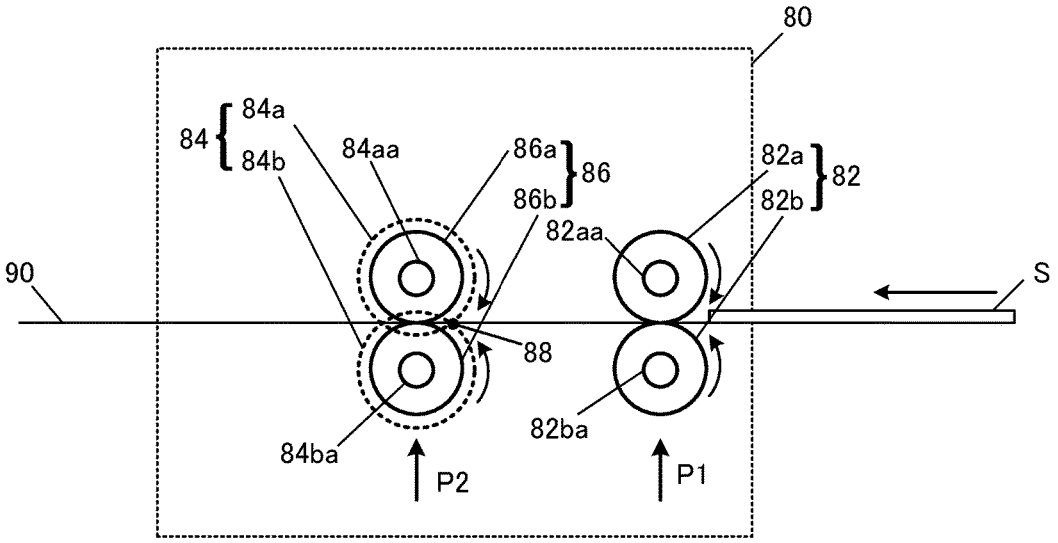
FIGS. 3A and 3B illustrate a configuration of a sheet cutting device of the embodiment.
Figure 3B:
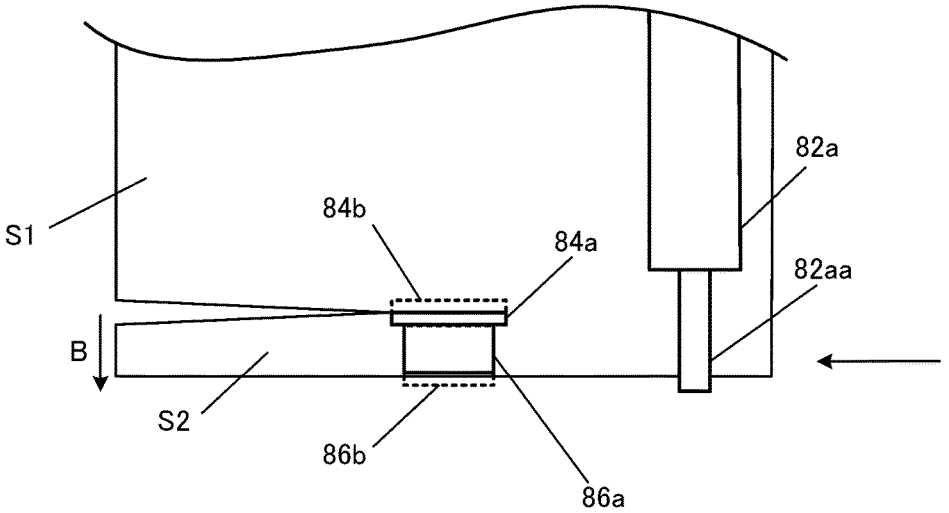

Next, with reference to FIGS. 3A and 3B, a configuration of sheet cutting device 80 is described. FIG. 3A is a front sectional view of sheet cutting device 80. FIG. 3B is a top view of sheet cutting device 80 which illustrates one end of sheet S in the sheet width direction. To form an image having no margin at both end portions of the sheet, that is, for frameless-printing, sheet cutting device 80 cuts out the margin at both end portions of sheet S in the sheet width direction of sheet S. Sheet S has a rectangular image formation region at its center portion and a non-image region (margin) around the rectangular image formation region.

In sheet S conveyance path 90, sheet cutting device 80 includes first conveyance roller pair 82, rotation blade pair 84 and second conveyance roller pair 86.

First conveyance roller pair 82 includes rotatable first roller 82*a* and second roller 82*b*, and rotates while tightly sandwiching sheet to convey sheet S. The rotation of first roller 82*a* and second roller 82*b* is controlled by control section 100. Control section 100 rotates first roller 82*a* clockwise around rotational axis 82*aa*, and rotates second roller 82*b* counterclockwise around rotational axis 82*ba* (see FIG. 3A). First roller 82*a* and second roller 82*b* are in pressure contact with each other with a predetermined first load P1 by a first pressure contact separation section using an eccentric cam, a compression spring and the like (not illustrated). In the present embodiment, first conveyance roller pair 82 is a registration roller pair which can correct skewing of sheet S that is being conveyed.

In conveyance path 90 of sheet S, rotation blade pair 84 is disposed on the downstream side of first conveyance roller pair 82. Rotation blade pair 84 includes rotatable first rotation blade 84*a* and second rotation blade 84*b*, and rotates while sandwiching sheet S to cut sheet S in the direction parallel to the conveyance direction. In the present embodiment, first rotation blade 84*a* is an outer blade, and second rotation blade 84*b* is an inner blade. First rotation blade 84*a* and second rotation blade 84*b* mesh with each other with a predetermined overlap amount. Then, sheet S is cut at upstream meshing part 88. Sheet S1 thus cut (which is also referred to as "main part") has a so-called frameless image in which the entire surface is the image formation region.

The rotation of first rotation blade 84*a* and second rotation blade 84*b* is controlled by control section 100. Control section 100 rotates first rotation blade 84*a* clockwise around rotational axis 84*aa*, and rotates second rotation blade 84*b* counterclockwise around rotational axis 84*ba* (see FIG. 3A).

Second conveyance roller pair 86 includes third roller 86*a* and fourth roller 86*b*. Third roller 86*a* is rotatable around a rotational axis identical to rotational axis 84*aa* of first rotation blade 84*a*. Fourth roller 86*b* is rotatable around a rotational axis identical to rotational axis 84*ba* of second rotation blade 84*b*. Second conveyance roller pair 86 rotates while tightly sandwiching cut waste sheet S2 cut out by rotation blade pair 84 (see FIG. 3B) to convey the cut waste sheet S2 in the conveyance direction of sheet S. Third roller 86*a* and fourth roller 86*b* are in pressure contact with each other by a second pressure contact separation section (not illustrated) using an eccentric cam, a compression spring and the like with second load P2 which is smaller than first load P1.

Control section 100 controls the rotations of first and second conveyance roller pairs 82 and 86 such that the rotational speed of second conveyance roller pair 86 is higher than the rotational speed of first conveyance roller pair 82. In the present embodiment, third roller 86*a* rotates clockwise in response to the rotation driving force of first rotation blade 84*a*, and fourth roller 86*b* rotates counterclockwise to follow the rotation of third roller 86*a*. Control section 100 controls the rotations of first conveyance roller pair 82 and rotation blade pair 84 such that the rotational speed of second conveyance roller pair 86 is higher than the rotational speed of first conveyance roller pair 82.

On the downstream side of second conveyance roller pair 86 in the conveyance direction of cut waste sheet S2, a rotary cutter (not illustrated) that cuts cut waste sheet S2 at a predetermined interval (for example, 50 mm) in a direction orthogonal to the conveyance direction is provided. Cut waste sheet S2 cut out by the rotary cutter is conveyed to a cut waste sheet box not illustrated and housed in the cut waste sheet box.

As has been described in detail, in the present embodiment, image forming apparatus 1 includes: first conveyance roller pair 82 including a rotatable first roller 82*a* and rotatable second roller 82*b*, and configured to convey sheet by rotating while tightly sandwiching sheet S; rotation blade pair 84 disposed on a downstream side of first conveyance roller pair 82 in a conveyance path of sheet S and including a rotatable first rotation blade 84*a* and rotatable second rotation blade 84*b*, rotation blade pair 84 being configured to cut sheet S in a direction parallel to the conveyance direction by rotating while sandwiching sheet S; and second conveyance roller pair 86 including third roller 86*a* which is rotatable around a rotational axis identical to a rotational axis of first rotation blade 84*a* and fourth roller 86*b* which is rotatable around a rotational axis identical to a rotational axis of second rotation blade 84*b*, second conveyance roller pair 86 being configured to convey a cut waste sheet cut by rotation blade pair 84 in the sheet conveyance direction by rotating while tightly sandwiching the cut waste sheet. A rotational speed of second conveyance roller pair 86 is controlled at a rotational speed higher than a rotational speed of first conveyance roller pair 82.

According to the present embodiment employing the above-mentioned configuration, deflection of sheet S at the time when sheet S advances to rotation blade pair 84 is prevented by the difference of the rotational speed between second conveyance roller pair 86 and first conveyance roller pair 82. Consequently, sheet S is prevented from being cut at a position on the upstream side of a nip portion where first rotation blade 84*a* and second rotation blade 84*b* mesh with each other, and in turn, it is possible to prevent the cut surface of sheet S from being napped. In addition, since third roller 86*a* and fourth roller 86*b* for conveying cut waste sheet S2 are configured to rotate around a rotational axis identical to the rotational axis of first rotation blade 84*a* and second rotation blade 84*b*, sheet S can be accurately cut in a direction parallel to the conveyance direction even if rotation blade pair 84 has true circle unevenness and rotation unevenness. Further, the relationship (equal relationship) between the linear velocity of sheet S and the linear velocity of rotation blade pair 84 at the time when sheet S is cut is stabilized, and a difference in linear velocity between main part S1 and cut waste sheet S2 after the cutting of sheet S (which tends to be caused when thin paper is used as sheet S and when the cutting width is small in particular) is prevented. Accordingly, waviness of the cut surface of sheet S can be prevented. In the above mentioned manner, quality problem of the cut surface of sheet S can be prevented.

In addition, in the present embodiment, first roller 82*a* and second roller 82*b* are in pressure contact with each other with first load P1, and third roller 84*a* and fourth roller 84*b* are in pressure contact with each other with second load P2 smaller than first load P1. With this configuration, cut waste sheet S2 can be conveyed toward the outside relative to the sheet width direction (the direction of arrow B in FIG. 3B) to a certain degree by slipping cut waste sheet S2 after the cutting of sheet S, and consequently main part S1 and cut waste sheet S2 can be prevented from making close contact with each other. It should be noted that, when cut waste sheet S2 is excessively directed to the outside relative to the sheet width direction, the entering angle of cut waste sheet S2 to the rotary cutter is an acute angle and cut waste sheet S2 is torn from main part S1, and as a result, the cut surface of sheet S may be napped. In view of this, it is desirable to set first load P1 and second load P2 in accordance with the cutting width and the rigidity of sheet S such that cut waste sheet S2 is not excessively directed toward the outside relative to the sheet width direction.

In addition, in the present embodiment, first conveyance roller pair 82 is a registration roller pair capable of correcting the skewing of sheet S that is being conveyed. With this configuration, it is possible to surely prevent a situation where sheet S in a skewed state advances to upstream meshing part 88 of first rotation blade 84*a* and second rotation blade 84*b*, and thus the margin of sheet S can be accurately cut out.

It is to be noted that, in the above-mentioned embodiment, first rotation blade 84*a* and second rotation blade 84*b* may be an inner blade and an outer blade, respectively.

In addition, in the above-mentioned embodiment, fourth roller 86*b* may rotate counterclockwise in response to the rotation driving force of second rotation blade 84*b*, and third roller 86*a* may rotate clockwise to follow the rotation of fourth roller 86*b*.

Figure 4:
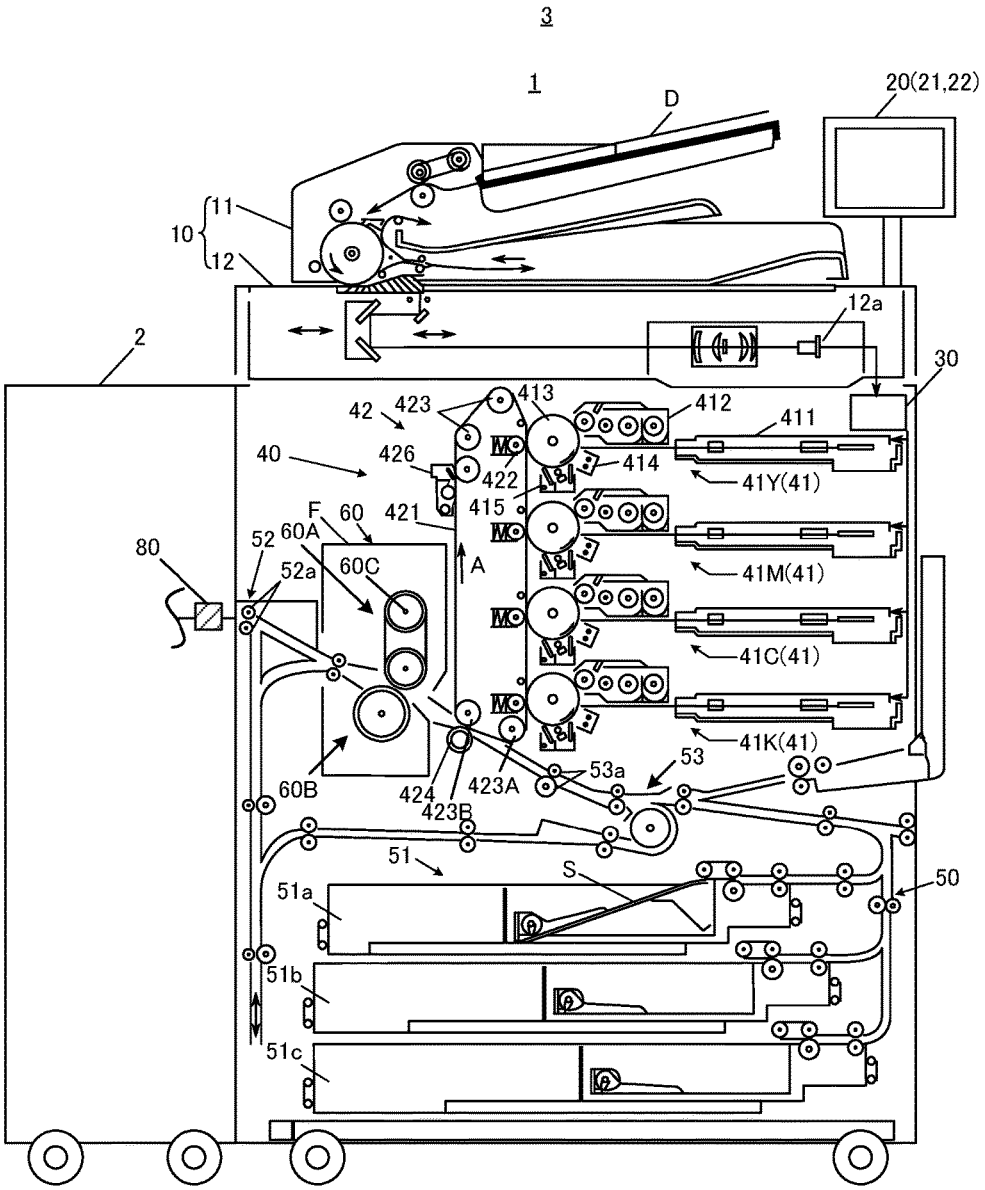
FIG. 4 schematically illustrates a configuration of an image formation system of the embodiment.

While sheet cutting device 80 is provided in image forming apparatus 1 in the above-mentioned embodiment, the present invention is not limited to this configuration. For example, sheet cutting device 80 may be provided in an image formation system composed of a plurality of units including image forming apparatus 1. The units include, for example, a post-processing apparatus, an external apparatus such as a control apparatus connected with a network, and the like. FIG. 4 illustrates a configuration in a case where sheet cutting device 80 is provided in image formation system 3 including image forming apparatus 1 and after-treatment apparatus 2, or more specifically, a case where sheet cutting device 80 is provided in the conveyance path of sheet S in after-treatment apparatus 2.

It should be understood by those skilled in the art that various modifications, combinations, sub-combinations and alterations may occur depending on design requirements and other factors in so far as they are within the scope of the appended claims or the equivalents thereof. While the invention made by the present inventor has been specifically described based on the preferred embodiments, it is not intended to limit the present invention to the above-mentioned preferred embodiments but the present invention may be further modified within the scope and spirit of the invention defined by the appended claims.

What is claimed is:

1. An image forming apparatus comprising:

a first conveyance roller pair including a rotatable first roller and a rotatable second roller, and configured to convey a sheet by rotating while tightly sandwiching the sheet;

a rotation blade pair disposed on a downstream side of the first conveyance roller pair in a conveyance path of the sheet and including a rotatable first rotation blade and a rotatable second rotation blade, the rotation blade pair being configured to cut the sheet in a direction parallel to the conveyance direction by rotating while sandwiching the sheet; and a second conveyance roller pair including a third roller which is rotatable around a rotational axis identical to a rotational axis of the first rotation blade and a fourth roller which is rotatable around a rotational axis identical to a rotational axis of the second rotation blade, the second conveyance roller pair being configured to convey a cut waste sheet cut by the rotation blade pair in the sheet conveyance direction by rotating while tightly sandwiching the cut waste sheet between the third roller and the fourth roller, wherein a rotational speed of the second conveyance roller pair is controlled at a rotational speed higher than a rotational speed of the first conveyance roller pair, and the fourth roller has a planar shape larger than that of the third roller in a plan view.

2. The image forming apparatus according to claim 1, wherein the first roller and the second roller are in pressure contact with each other with a first load, and the third roller and the fourth roller are in pressure contact with each other with a second load smaller than the first load.

3. The image forming apparatus according to claim 1, wherein the first conveyance roller pair is a registration roller pair capable of correcting skewing of the sheet that is being conveyed.

4. The image forming apparatus according to claim 1, wherein the first rotation blade is an outer blade, and the second rotation blade is an inner blade.

5. The image forming apparatus according to claim 1, wherein the third roller rotates in response to a rotation driving force of the first rotation blade, and the fourth roller rotates to follow rotation of the third roller.

6. An image formation system comprising a plurality of units including an image forming apparatus, the image formation system including:

a first conveyance roller pair including a rotatable first roller and a rotatable second roller, and configured to convey a sheet by rotating while tightly sandwiching the sheet;

a rotation blade pair disposed on a downstream side of the first conveyance roller pair in a conveyance path of the sheet and including a rotatable first rotation blade and a rotatable second rotation blade, the rotation blade pair being configured to cut the sheet in a direction parallel to the conveyance direction by rotating while sandwiching the sheet; and a second conveyance roller pair including a third roller which is rotatable around a rotational axis identical to a rotational axis of the first rotation blade and a fourth roller which is rotatable around a rotational axis identical to a rotational axis of the second rotation blade, the second conveyance roller pair being configured to convey a cut waste sheet cut by the rotation blade pair in the sheet conveyance direction by rotating while tightly sandwiching the cut waste sheet between the third roller and the fourth roller, wherein a rotational speed of the second conveyance roller pair is controlled at a rotational speed higher than a rotational speed of the first conveyance roller pair, and the fourth roller has a planar shape larger than that of the third roller in a plan view.

7. The image forming apparatus according to claim 1, wherein the second conveyance roller pair is located laterally outboard of the rotation blade pair relative to a central axis of the sheet extending along the sheet conveyance direction.

* * * * *